US009504280B2

(12) United States Patent
Levian

(10) Patent No.: US 9,504,280 B2
(45) **Date of Patent: *Nov. 29, 2016**

(54) POSTURE-IMPROVING GARMENT

(71) Applicant: Michael Levian, Beverly Hills, CA (US)

(72) Inventor: Michael Levian, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/866,451

(22) Filed: Sep. 25, 2015

(65) Prior Publication Data

US 2016/0015084 A1 Jan. 21, 2016

Related U.S. Application Data

(63) Continuation-in-part of application No. 13/673,794, filed on Nov. 9, 2012, now Pat. No. 9,167,854.

(60) Provisional application No. 61/609,568, filed on Mar. 12, 2012.

(51) Int. Cl.

| | |
|---|---|
| ***A41B 1/08*** | (2006.01) |
| ***A41B 9/06*** | (2006.01) |
| ***A41B 9/16*** | (2006.01) |

(52) U.S. Cl.

CPC . *A41B 1/08* (2013.01); *A41B 9/06* (2013.01); *A41B 9/16* (2013.01)

(58) Field of Classification Search

CPC ..... A41B 1/00; A41B 1/08; A41B 9/06; A41B 9/00; A41D 1/04; A41D 1/00; A41D 13/0002; A41D 13/0007; A41D 13/1236; A41D 13/1245; A61F 5/02; A61F 5/026

USPC ..... 2/69, 113, 120, 308, 310, 311, 316, 2/326, 329, 330; 602/5, 19, 20; 473/266, 473/269, 276, 277

See application file for complete search history.

(56) References Cited

U.S. PATENT DOCUMENTS

| | | | | |
|---|---|---|---|---|
| 4,018,226 A | | 4/1977 | Korgemets | |
| 4,067,066 A | * | 1/1978 | Bruno | A45C 9/00 2/105 |

(Continued)

OTHER PUBLICATIONS

U.S. Appl. No. 13/673,794—Office Actions and Responses thereto.

*Primary Examiner* — Anna Kinsaul
*Assistant Examiner* — James Heracklis
(74) *Attorney, Agent, or Firm* — Robert A. Seldon

(57) ABSTRACT

A garment for improving the wearer's posture provides cords that, when secured in place, exert a slight pressure against the wearer's shoulders each time he/she starts to slouch, serving as a reminder to be more erect. The garment had a horizontal channel that is located around the body of the user, preferably just below the breast area, that accommodates a first cord. The garment further includes vertically-extending channels that extend upward from the horizontal channel and over the shoulders of the user. Respective cords in each vertical channel pass over respective shoulders of the garment from the front of the garment, and extend down the back of the garment to a position at which they are accessible to a person wearing the garment (the "user"), and are anchored in the front of the garment by the horizontal cord in such a way that when the vertical cords are sufficiently pulled at the rear of the garment and secured in place, they lightly engage the front of the wearer's shoulders so that the wearer will feel a slight pressure against his/her shoulders each time he/she starts to slouch, serving as a reminder to be more erect.

16 Claims, 7 Drawing Sheets

(56) References Cited

U.S. PATENT DOCUMENTS

| | | | | |
|---|---|---|---|---|
| 4,273,328 | A | 6/1981 | Ozbey et al. | |
| 5,299,323 | A | 4/1994 | Schaefer et al. | |
| 6,315,747 | B1 | 11/2001 | Toole | |
| 6,440,094 | B1 | 8/2002 | Maas | |
| 7,134,969 | B2 | 11/2006 | Citron et al. | |
| 7,395,557 | B1 | 7/2008 | Ledyard | |
| 7,871,388 | B2 | 1/2011 | Brown | |
| 7,914,473 | B2 | 3/2011 | Josey | |
| 7,930,769 | B2 | 4/2011 | Stern | |
| 8,083,693 | B1 * | 12/2011 | McKeon | A61B 5/103 600/587 |
| 9,167,854 | B2 * | 10/2015 | Levian | A41B 1/08 |
| 2003/0153855 | A1 * | 8/2003 | Rhee | A61F 5/026 602/19 |
| 2004/0194190 | A1 | 10/2004 | Gathings, Jr. | |
| 2004/0244097 | A1 | 12/2004 | Kassai et al. | |
| 2005/0070830 | A1 | 3/2005 | Schultz | |
| 2009/0126084 | A1 * | 5/2009 | Fenske | A41C 3/005 2/338 |
| 2012/0179080 | A1 * | 7/2012 | Sakamoto | A61F 5/026 602/19 |

* cited by examiner

POSTURE-IMPROVING GARMENT

CLAIM OF PRIORITY

This application is a continuation-in-part of co-pending U.S. patent application Ser. No. 13/673,794 filed Nov. 9, 2012, the priority of which is claimed, which claims the benefit of U.S. Provisional Patent Application 61/609,568 filed Mar. 12, 2012, the priority of which is claimed.

INCORPORATION BY REFERENCE

The content of my U.S. patent application Ser. No. 13/673,794 and my U.S. Provisional Patent Application 61/609,568 are hereby incorporated by reference.

FIELD OF THE INVENTION

The invention relates to a posture-improving garment that can be worn as an undershirt.

BACKGROUND

A number of methods have been proposed to improve posture by means of a garment having built-in mechanisms of various sorts, examples of which are found in U.S. Pat. No. 7,395,557, U.S. Pat. No. 7,134,969, U.S. Pat. No. 7,871,388, U.S. Pat. No. 6,440,094 and U.S. Pat. No. 4,273,328. Each of these references is hereby incorporated by reference.

Garments having channels through which one or more cords can pass to adjust the shape of a garment are described and illustrated in, for example, U.S. Pat. No. 4,018,226, U.S. Pat. No. 5,299,323, U.S. Pat. No. 7,930,769, and published U.S. Patent Application 2004/0194190. Each of these references is hereby incorporated by reference.

All the foregoing methods and configurations involve the incorporation of bands or straps that substantially increase the cost and/or bulk of the garment, or do not suggest or teaching method useful in improving the posture of the user.

SUMMARY

A structure and method are provided for enabling one wearing a garment constructed to improve his or her posture simply by pulling on cords that, when secured in place, serve to exert a slight pressure against the wearer's shoulders each time he/she starts to slouch, serving as a reminder to be more erect. The user's body will soon naturally acquire a better posture owing to the constant reminder provided by the garment each time slouching begins owing to proprioception (the body's sense of the relative position of its neighboring parts).

The garment carries a first generally horizontally-extending cord that is positioned to extend about the user's body of a user in the region of the user's rib cage. The fit of the first cord is sufficiently adjustable to enable the user's body to resist upward movement of the garment.

The garment also carries a pair of generally vertically-extending cords extending upwardly along the front of the garment from the first cord (or a region of the garment adjacent the first cord), on respective sides of the garment's centerline. The vertically-extending cords pass over respective shoulders of the garment, and extend down the back of the garment to a position at which they are accessible to a person wearing the garment (the "user").

The generally vertically-extending cords are substantially secured against upward movement at the front of the garment by the generally horizontally-extending cord, so that an appropriate pulling and securing of the generally vertically-extending cords at the rear of the garment will subsequently cause pressure to be exerted against the user's shoulders as the user slouches, serving as a reminder to the user to be more erect. The user's body will soon naturally acquire a better posture owing to the constant reminder provided by the garment each time slouching begins owing to proprioception (the body's sense of the relative position of its neighboring parts).

These and further details of the invention will be apparent to those of ordinary skill in the art from reading a description of the preferred embodiment of the invention described below, of which the drawing forms a part.

DETAILED DESCRIPTION

Referring to the Figures, a garment 10 constructed in accordance with the invention is illustrated in the form of a tank top or sleeveless undershirt, but it will be clear that any other type of garment that covers the chest area of a user may be employed as well without departing from the scope or spirit of the invention.

When referencing the garment and its elements, the terms "left" and "right" will be used to respectively denote the left and right side of the garment when worn by a user. Thus, when looking at the front of the garment in FIG. 1, the "right" will be on the reader's left. When looking at the rear of the garment in FIG. 2, the "right" will be on the reader's right.

Figure 1:
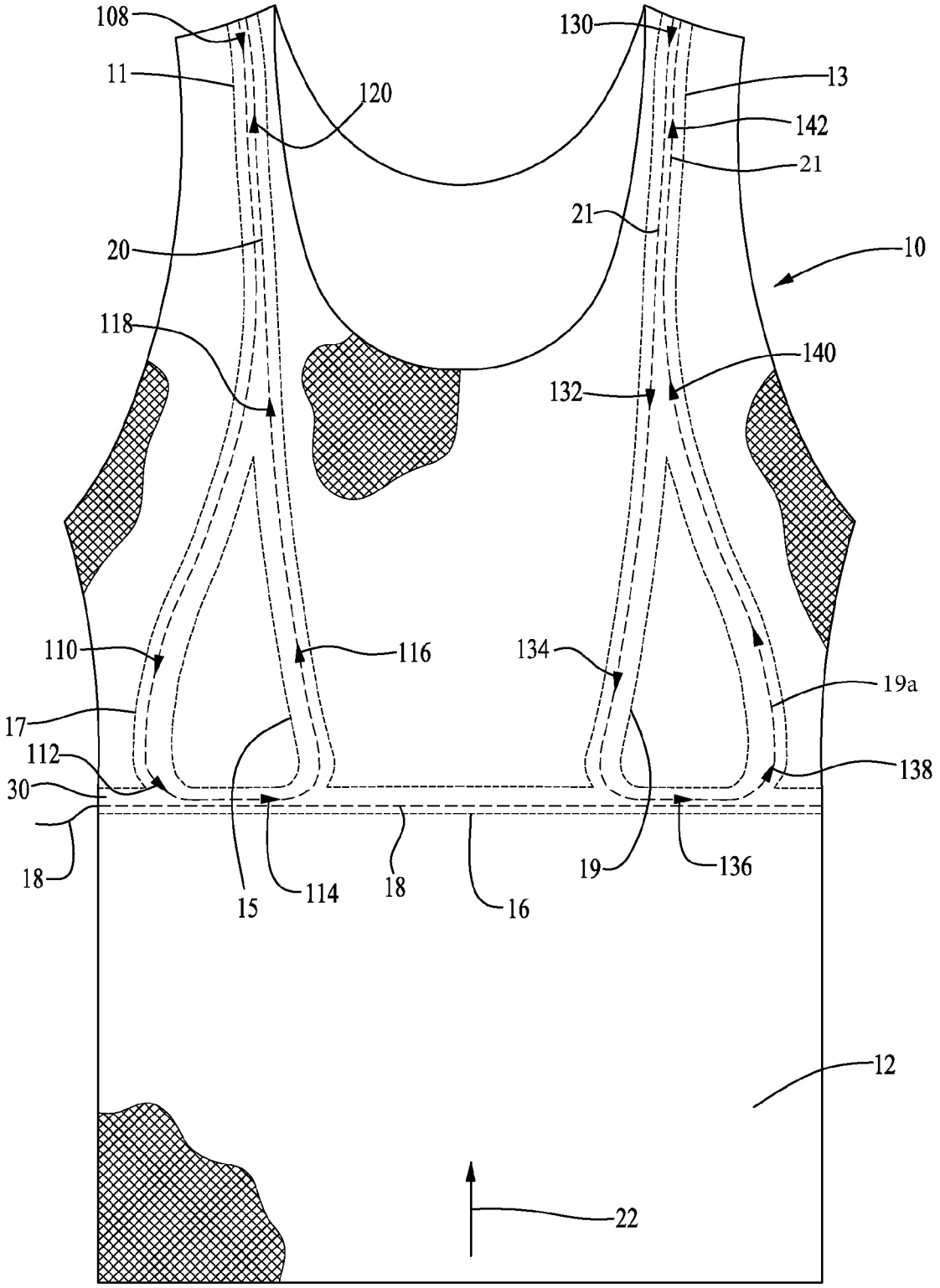
FIG. 1 is a front elevation view of a garment constructed in accordance with the invention.
Figure 2:
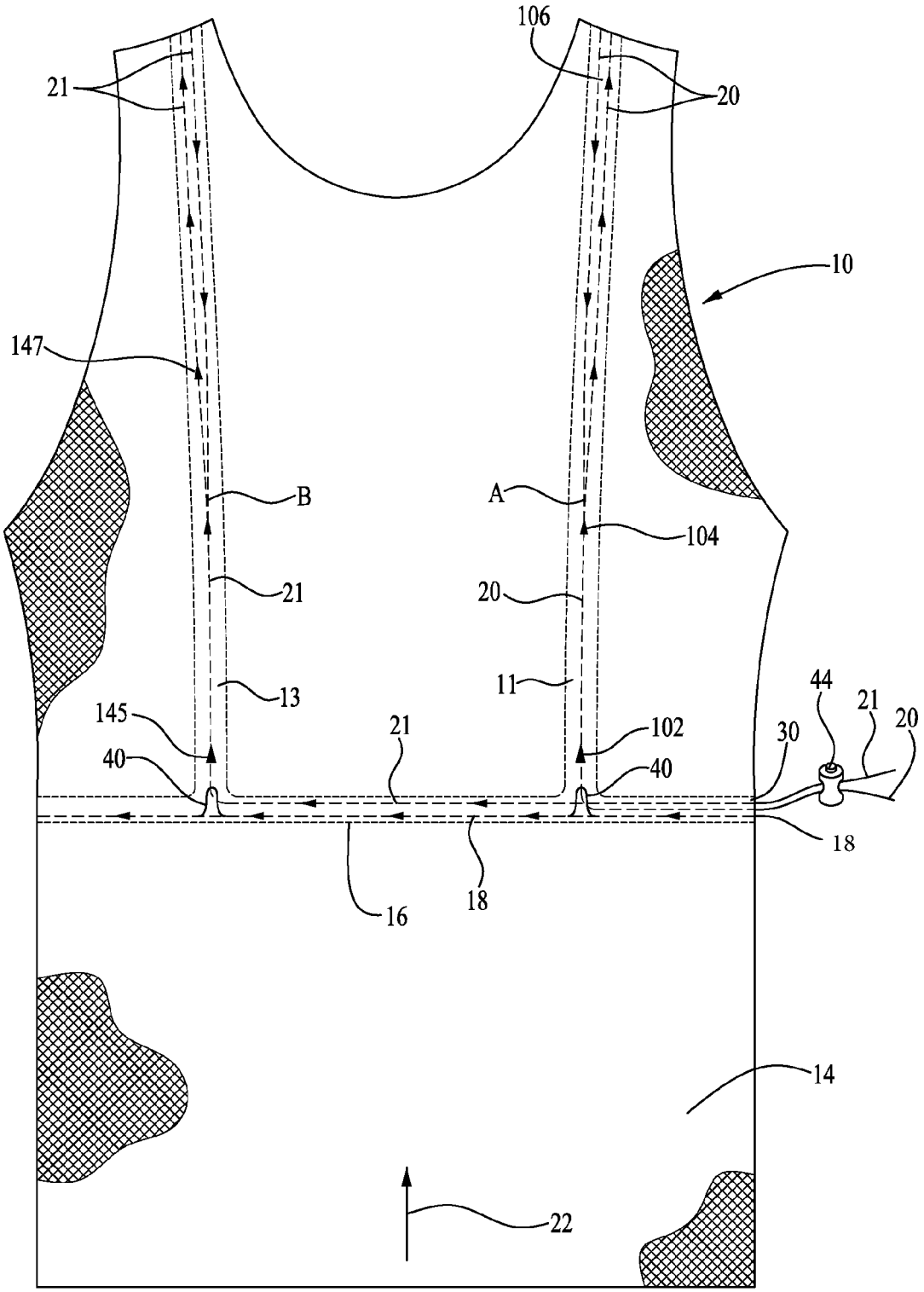
FIG. 2 is a rear elevation view of a garment constructed in accordance with the invention.
Figure 3:
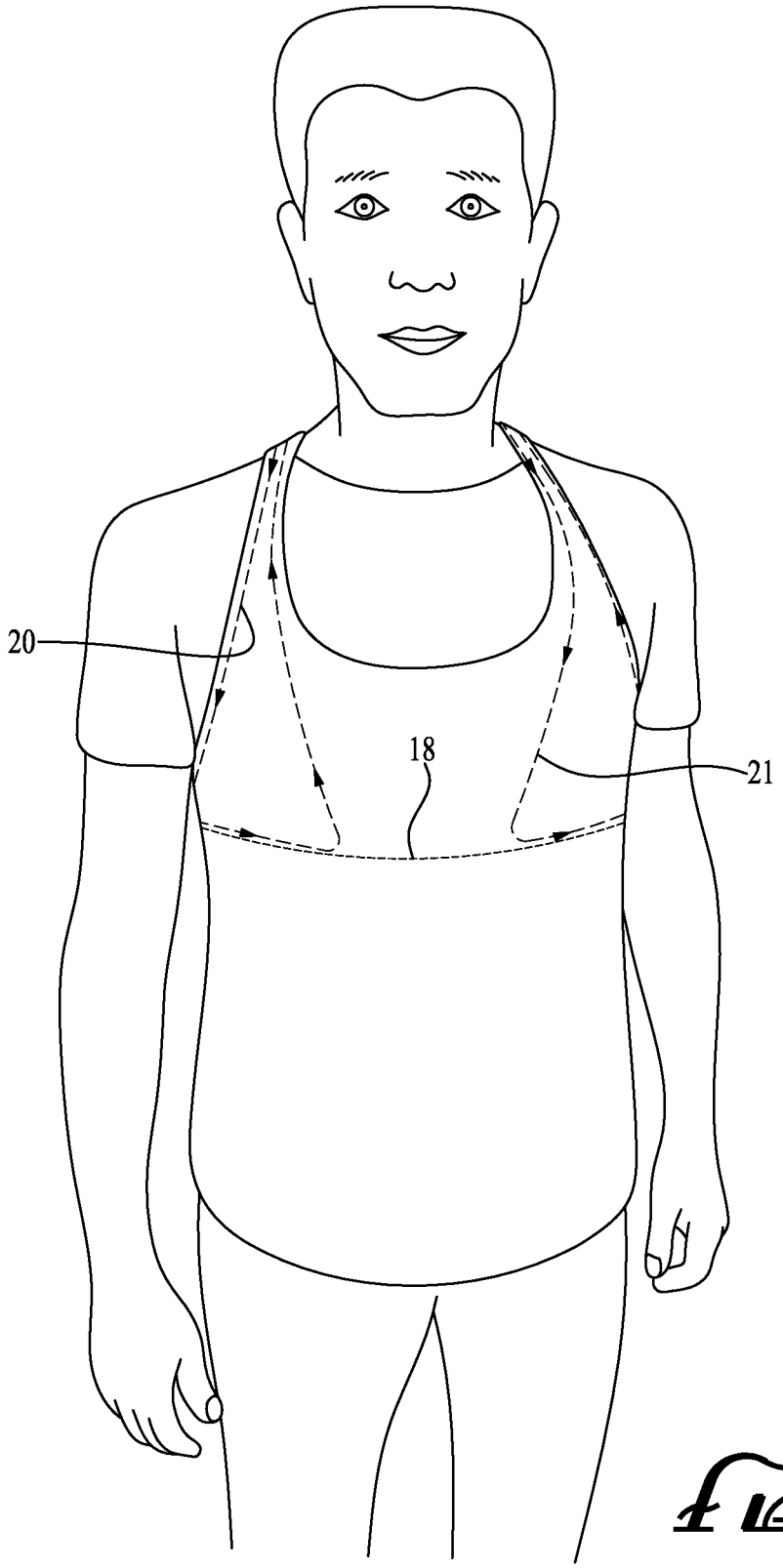
FIG. 3 is a front elevation view of a person wearing the garment of FIG. 1.

FIG. 1 is a front elevation view of a garment constructed in accordance with the invention, illustrating the front 12 of the garment 10, while FIG. 2 is a rear elevation view of one embodiment of the garment of FIG. 1. A generally horizontally-extending channel 16 is formed within, or on the interior or exterior surface of, the garment and is positioned to extend around the garment just below the breast area of the user, whether male or female. The channel 16, hereinafter conveniently referred to as the "horizontal channel" for the sake of simplicity, can alternatively be positioned to extend around another region of the user's chest or around the garment just under the user's chest or rib cage, but these alternatives are not preferred.

As with other channels to be described, the horizontal channel 16 is illustrated in broken lines for the purpose of visual clarity. It should be understood that the channels preferably lie under a layer of material that touches (or is closest to) the user's body, or the channel may be formed on that layer of material. In another variation, the channels may be formed on the garment's exterior.

Each channel can be formed by overlapping the garment material to form an elongated loop that will serve as the channel, and then sewing (or otherwise affixing) the overlapped layers together along a line where the layers interface to define the channel. Alternatively, one or more channels can each be formed by a strip of material affixed along its outer edges to the interior or exterior surface of the garment, as the case may be; e.g., by glue or by sewing, to form the channel between the strip and the garment surface.

It will be apparent to those of ordinary skill in the art that the horizontal channel 16 need not circumscribe the garment by a full 360°, but only sufficiently to yield the desired effect as hereinafter described. However, it is preferable to circumscribe the garment for substantially 360°.

As illustrated in FIG. 1, the preferred horizontal channel 16 communicates with generally vertically-extending right and left channels 11, 13 that extend upwardly from the horizontal channel 16 and over respective shoulders of the garment. At least a portion of the preferred vertically-extending right and left channels 11, 13 (hereinafter referred to as the "vertical channels" for convenience) are flexible enough to permit the vertical distance between the horizontal channel 16 and top of the garment to be changed for reasons that will become clear.

Looking at the front of the garment 10 in FIG. 1, it may be seen that the preferred right vertical channel 11 includes a loop-shaped segment in the front of the garment, forming two generally vertically-extending arms 15, 17 that are separated by an interjacent segment lying within, and preferably formed by, a section of the horizontal channel 16. Alternatively, the interjacent segment may be a segment that does not lie within the horizontal channel 16, but is instead affixed to it via adjacent channel walls that are (for example) sewn or glued to each other or to interjacent coupling material.

Similarly, the preferred left vertical channel 13 is also loop-shaped in the front, forming two generally vertically-extending arms 19, 19*a* separated by an interjacent segment lying within, and preferably formed by, the horizontal channel 16. The interjacent segment can alternatively be affixed to the horizontal channel as described above with respect to the interjacent segment of the vertical channel 11.

FIG. 2 is a rear elevation view of a garment constructed in accordance with the invention. Turning to FIG. 2, it may be seen that the right and left vertical channels 11, 13 pass over respective shoulders of the garment, extend down the back 14 of the garment and communicate with respective regions of the horizontal channel 16 in the rear of the garment. Preferably, said respective regions are laterally separated and lie generally vertically below respective shoulders of the garment.

As described earlier, any or all of the channels 16, 11, 13, 15, 17, 19 and 19*a* can be formed by looping and sewing together (or otherwise affixing to each other) garment material to thereby form the channel. Alternatively, one or more channels can each be formed by a strip of material affixed along its outer edges to the surface of the garment, e.g., by glue or by sewing, to form the channel between the strip and the garment. Another alternative simply employs elongated tubular structures affixed to the garment, (e.g., by glue or by sewing) which function as the channels. Yet another alternative is to employ a plurality of loops separated from each other, similar to the belt loops on a pair of pants, to form the channel via the path passing through the plurality of loops. In any case, at least the arms 15, 17, 19, 19*a* (FIG. 1) of the vertically directed channels 11, 13 are flexible enough to allow the horizontal channel 16 to be raised in the direction 22 as hereinafter described.

Cords 18, 20, 21 are disposed through the channels, and emerge from the shirt at 30. As shown in FIGS. 1 and 2, one cord 18 (hereinafter, the "horizontal cord") extends around the garment through the horizontal channel 16, with one or both ends emerging from an opening 30 in the shirt preferably located on the side of the shirt below the arm. The cord 18 has a pair of tiny loops 40 preferably positioned to lie directly under a respective vertical channel for reasons hereinafter described.

As will also be described later, the horizontal cord 18 is pulled, when the garment is to be used for posture control, to sufficiently tighten the region of the horizontal channel about the user's body to obtain a desired result. If the garment is configured so that both ends of the cord 18 emerge from the opening, both ends are pulled, and then tied or clamped to prevent loosening. If the garment is configured so that only one end of the cord 18 emerges from the opening, the cord 18 within the channel should preferably be of sufficient length to extend at least approximately 270° around the user, with the non-emerging end being affixed or restrained within the horizontal channel so that the pulling of the emerging end does not result in the cord simply being pulled out of the horizontal channel instead of causing a tightening against the user's body.

The second cord 20 (hereinafter, the "first vertical cord") is illustrated as extending into the horizontal channel 16 from the opening 30, and passing thorough the loop 40 lying under the right vertical channel 11, and then extending upward within the right vertical channel 11 in the back of the garment and over the right shoulder as illustrated by the arrows at 102, 104 and 106. As then shown in FIG. 1, the first vertical cord 20 passes downwardly within the right vertical channel 11 in the front of the shirt as shown by the arrows 108, 110, and into the horizontal channel 16 as shown by the arrow 112.

As shown by the arrow 114, the first vertical cord 20 then extends across the right loop segment that preferably lies within the horizontal channel 16, and up the right vertical channel 11, as shown by arrows 116, 118, 120. The first vertical cord 20 then extends down the right vertical channel 11 in the rear of the garment to Point "A", where it is tied or otherwise affixed to its upwardly extending segment. Point "A" may be located anywhere along the cord without departing from the scope of the invention so long as it achieves the purpose and function hereinafter described.

The third cord 21 (hereinafter, the "second vertical cord") extends similarly up and over the left shoulder of the garment. As illustrated in FIG. 2, the second vertical cord 21 extends into the horizontal channel 16 from the opening 30, and passes thorough the loop 40 lying under the left vertical channel 13. It then extends upward via the left vertical channel 13 and over the left shoulder as illustrated by the arrows at 145, 147. As then shown in FIG. 1, the second vertical cord 21 passes downwardly within the left vertical channel 13 in the front of the shirt as shown by the arrows 130, 132, 134 and into the horizontal channel 16 as shown by the arrow 136.

As shown by the arrow 136, the second vertical cord 21 then extends across the left loop segment that preferably lies within the horizontal channel 16, and up the left vertical channel 13, as shown by arrows 138, 140, 142. The second vertical cord 20 then extends down left vertical channel 13 at the rear of the garment (FIG. 2) to Point "B", where it is tied or otherwise affixed to its upwardly extending segment. Point "B" may be located anywhere along the cord without departing from the scope of the invention so long as it achieves the purpose and function hereinafter described.

As can be appreciated from FIGS. 1 and 2, the pulling of the ends of the two vertical cords 20, 21 causes them to exert an upward force on the portions of the horizontal channel 16 that they respectively pass through at the front of the garment and thereby become tensioned by the anchoring effect of the horizontal cord. If the horizontal channel is not initially located in a position at which the user's body prevents upward movement, the horizontal channel will move upward slightly until its movement is stopped by the user's rib case or breast area which broaden in the upward direction. As previously described, at least a portion of the preferred vertical channels 11, 13 are flexible enough to permit that upward movement.

The loops 40 extend from the horizontal cord 18 to provide respective deflection surfaces within the generally-horizontal channel by which the vertical cords 20, 21 transition from a generally vertical orientation to a generally horizontal orientation. Each loop's cord-contacting surface thereby permits the vertical cords 20, 21 to exert an upward force at the horizontal channel 16 at the front of the garment when pulled generally horizontally by their ends at 30, while minimizing a lateral force component that would otherwise cause the garment rotate about the user's body.

Figure 4:
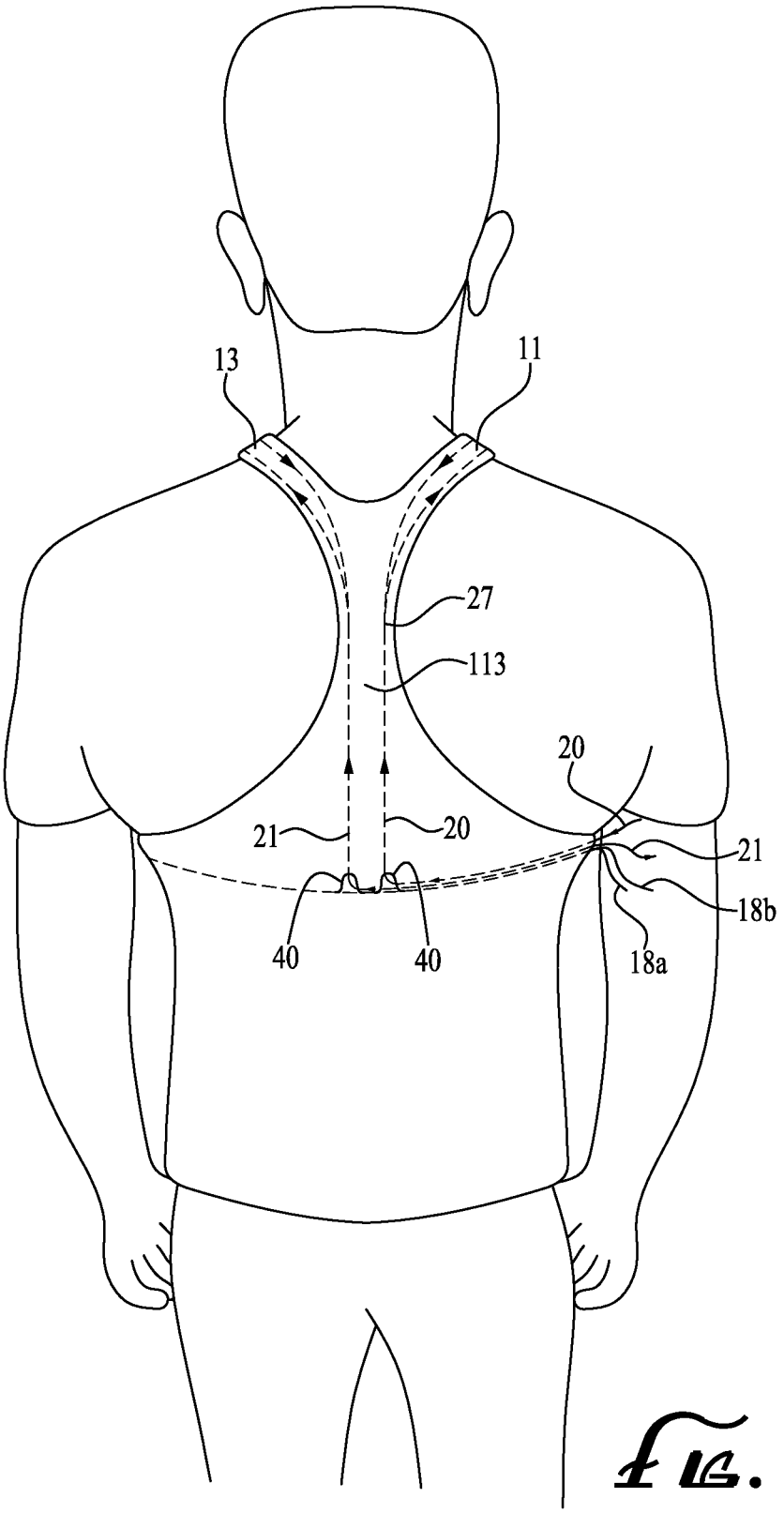
FIG. 4 is a rear elevation view of a person wearing another embodiment of a garment constructed in accordance with the invention.

FIG. 4 is a rear elevation view of a person wearing another embodiment of a garment constructed in accordance with the invention, wherein a single narrow band of garment material 27 extends between the user's shoulder blades and bifurcates to extend over the user's two shoulders. In this garment, the left and right vertical cords can extend within (or on) the band 27 by sharing a single channel or can extend in (or on) the band 27 in separate side-by-side channels. Preferably, the generally vertically-extending channels 13, 11 extend from the front of the garment over respective shoulders of the garment-wearing user and into a common vertically extending channel 113 at the rear of the garment that leads into the generally horizontal channel at the rear of the garment. In addition, FIG. 2 illustrates the optional garment configuration wherein both ends 18*a*, 18*b* of the horizontal cord 18 emerge from the opening in the garment.

Figure 5:
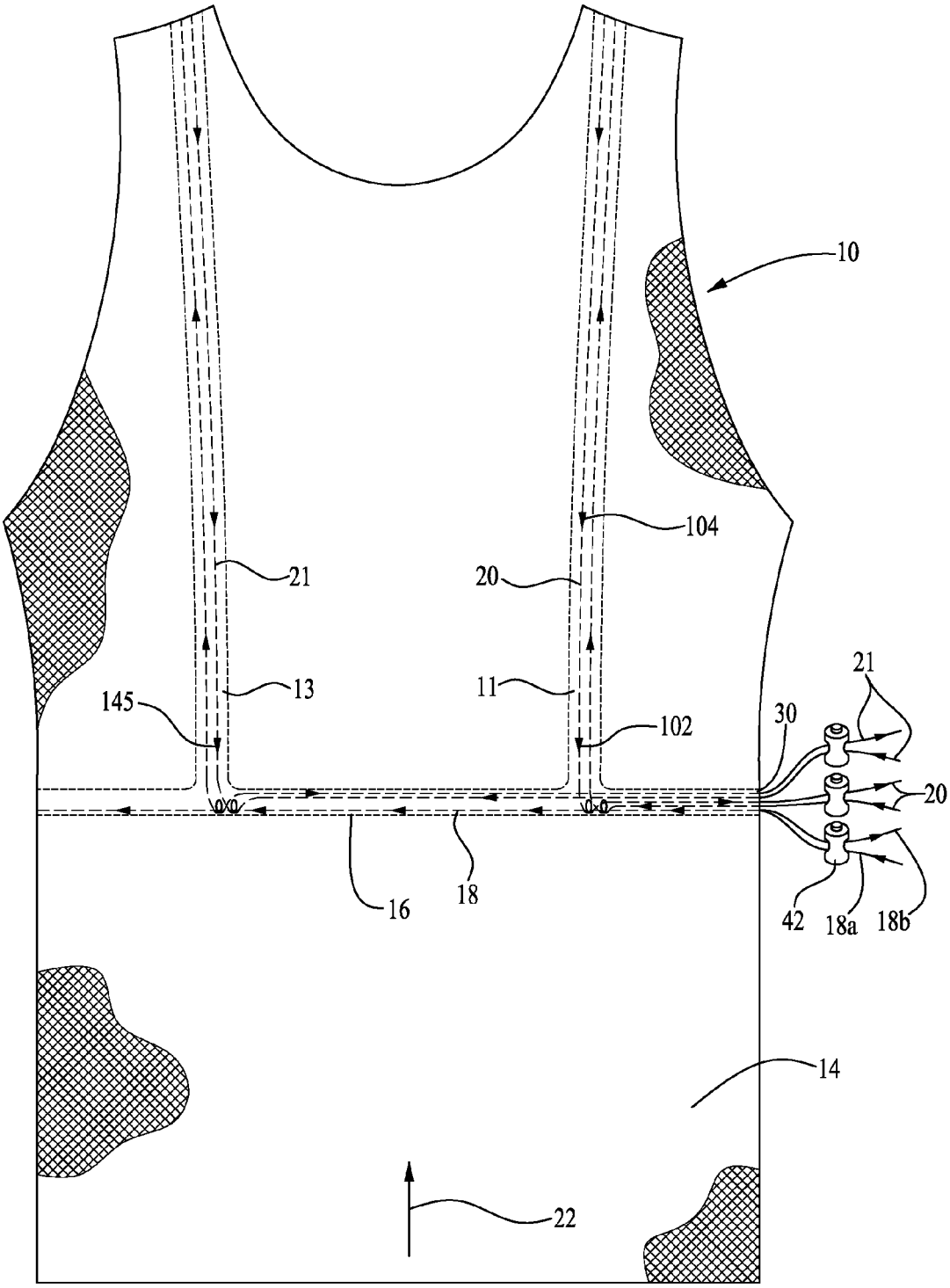
FIG. 5 is a rear elevation view showing another embodiment of a garment constructed in accordance with the invention.

FIG. 5 is a rear elevation view of a garment constructed in accordance with the invention wherein the outer surface of the horizontally-extending cord 18 acts as the deflection surface by which the vertical cords transition from passage through the respective vertical channel to passage through the horizontal channel at the rear of the garment. Here, the generally vertical cords 20, 21 are each looped around the horizontally-extending cord 18 (preferably once); this configuration believed to be less effective at reducing rotation of the garment about the user's body, and to be more condusive to generating unwanted friction against the horizontal cord 18 and possible binding.

Another less preferred configuration has both ends of each vertical cord 20, 21 emerging from the hole 30 instead of having one end of each cord affixed to itself as at respective cord at previously described positions "A" and "B". The emergence of these additional cord ends is believed to needlessly multiply the cord ends that must be secured by the user, and therefore needlessly complicate the securing of the cords as hereinafter described.

In use, the end(s) of the horizontal cord 18 adjacent hole 30 are first pulled until the horizontal cord is sufficiently snug to prevent the garment from substantially rising during use. The ends of the vertical cords 20, 21 are then pulled (preferably at the same time) while the person wearing the garment (the "user") assumes a position of good posture. It is accordingly preferred that the ends of vertical cords 20, 21 emerge from the shirt at the same location so that both cords can be conveniently secured at the same location, but the cords 20, 21 can emerge at different locations if desired (as, for example, illustrated in FIG. 6) without departing from the scope of the invention.

In use, the user can, for example, stand with his/her back against a wall to help achieve good posture. With the horizontal cord 18 pulled snugly around the user's torso and tied or otherwise secured, and with the user assuming a position of good posture, the vertical cords 20, 21 are pulled until there is a lightly snug pressure exerted by them against the front of the user's shoulders. The horizontal cord 18 prevents the garment from simply rising upward as the vertical cords 20, 21 are pulled. The channel 16 may rise very slightly, but its upward movement is resisted by the widening shape of the user's chest in the upward direction.

Figure 6:
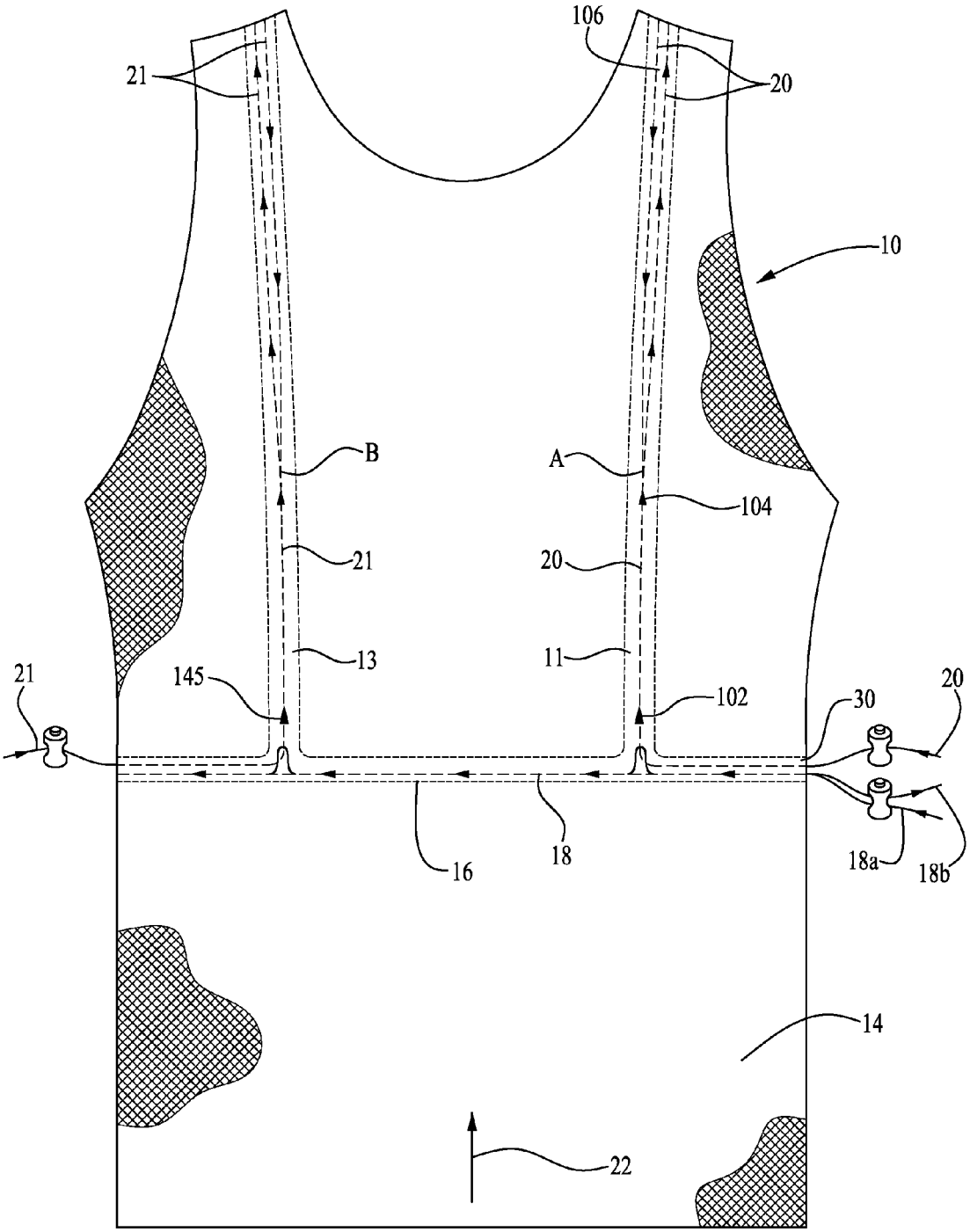
FIG. 6 is a rear elevation view showing another embodiment of a garment constructed in accordance with the invention.
Figure 7:
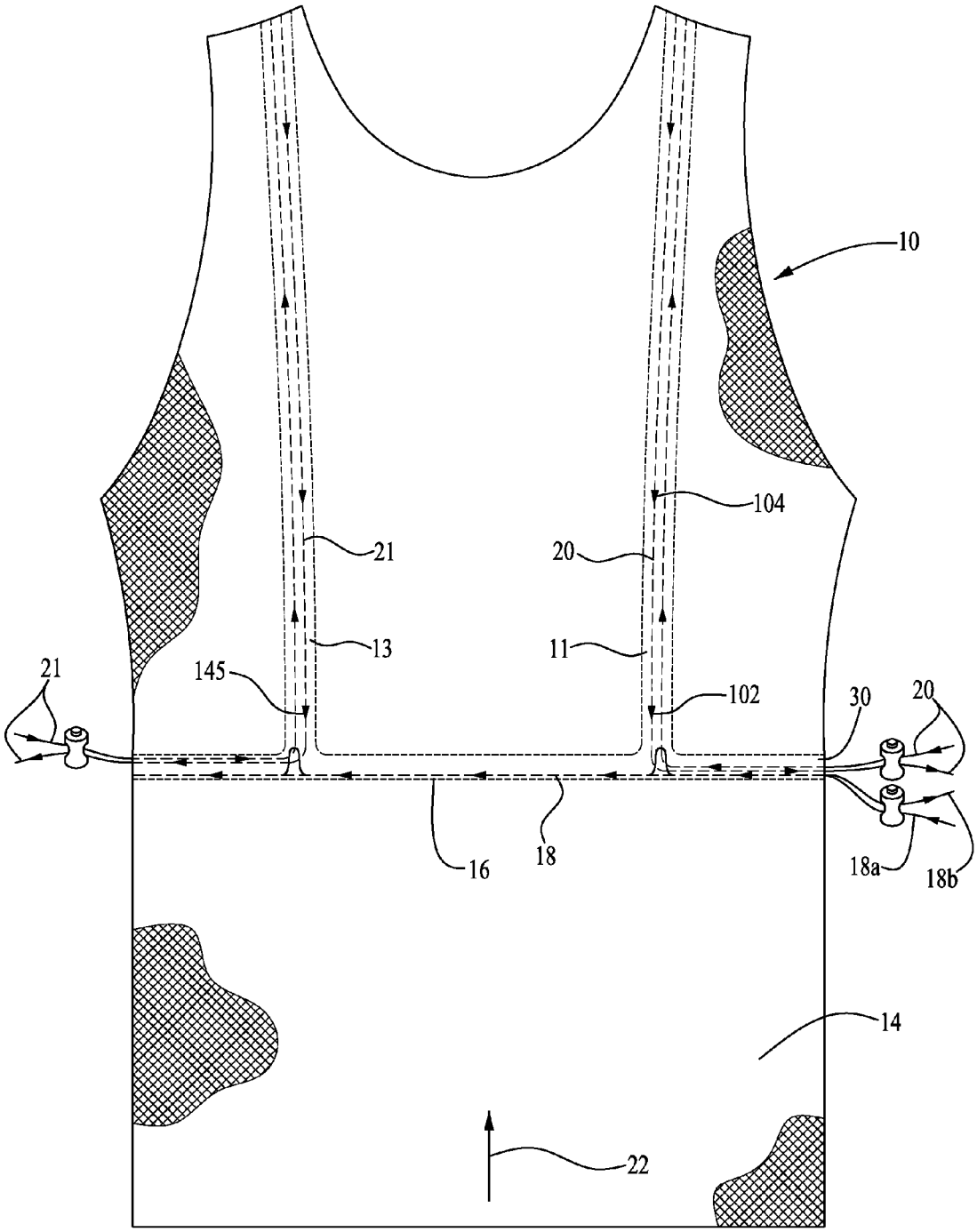
FIG. 7 is a rear elevation view showing another embodiment of a garment constructed in accordance with the invention.

Once the vertical cords 20, 21 are pulled sufficiently, they can be held in place by tying, or they can be retained by use of any of a myriad of fasteners, clamps or other securing devices known in the art or hereinafter devised. Examples of such devices can be found in U.S. Pat. Nos. 3,132,390, 3,965,544, 3,845,575 and 4,112,551. Each of these references is hereby incorporated by reference. Thus the two ends of the horizontal cord can be secured using a securing device 42, while the emerging end of vertical cord 20 and that of vertical cord 21 can conveniently be secured using the same securing device 44 (FIG. 2) or, less preferably, separate securing devices (FIGS. 5-7). A single device configured to secure all emerging cord ends either independently, together, or in some combination thereof can of course be used without departing from the scope of the invention.

Once the garment is adjusted as described above, the user will feel a slightly greater pressure against the front and top of his/her shoulders each time he/she starts to slouch, serving as a reminder to be more erect. The user's body will soon naturally acquire a better posture owing to the constant reminder provided by the garment each time slouching begins. Owing to proprioception (the body's sense of the relative position of its neighboring parts), wearing the garment for a short time each day will quickly train the body to assume good posture without the use of the garment.

Those of ordinary skill in the art will recognize that the coupling of the vertical cords 20, 21 to the horizontal chord 18 at the front of the garment can be accomplished in other equivalent ways. For example, instead of extending to or into respective portions of the horizontal channel 16 at the front of the garment, to be anchored in the front of the garment by horizontal cord 18, the vertical cords 20, 21 can be affixed to the horizontal cord 18 directly or to some other region of the garment. Whether being directly coupled to the horizontal cord 18, or being indirectly coupled to it via for example the wall of the horizontal channel, the vertical cords 20, 21 are coupled to the front of the garment in such a way that the horizontal cord 18 serves as an anchor against which the vertical cords are tensioned to create the shoulder-engagement utilized by the garment herein.

With respect to the channels, it may be noted that the channels may alternatively be formed by an elongated loop of material or by a plurality of loops separated from each other in a manner similar to belt loops on a pair of pants. As used herein, the term "channel" shall be understood to include these variations, wherein the channel is the path passing through the plurality of loops that have been arranged to accommodate the cord passing therethrough.

It should be understood that other minor changes, substitutions and alterations can be made herein by those of ordinary skill in the art without departing from the spirit and scope of the invention, as will be defined by appended claims. It is accordingly intended that all such changes, substitutions and alterations be included within the scope of the appended claims, and that claims be interpreted as broadly as possible under the Doctrine of Equivalents.

I claim:

1. A garment disposed about a centerline and having a front, a back, a left side and a right side, said garment comprising:

a generally horizontally-extending channel formed in the garment to extend generally horizontally about the body of a user wearing the garment;

a pair of generally vertically-extending channels, each extending over a respective shoulder of the garment-wearing user towards or into the generally horizontally-extending channel in the front of the garment, and each being in communication with the generally horizontally-extending channel in the rear of the garment; and cords disposed in the channels in such a way that, when pulled and secured, cause the generally horizontally-extending channel to be secured about the user's body and the generally vertically-extending channels to exert a lightly sensed pressure against the user's shoulders that increases when the user slouches as a reminder to be more erect, the cords including a first cord disposed within the generally horizontally-extending channel to substantially circumscribe the user's body, and second and third cords that extend through respective ones of the generally vertically-extending channels to the front of the garment in such a way that the first cord serves as an anchor against which the second and third cords can be tensioned to create said sensed pressure shoulder engagement utilized by the garment, said second and third cords further extending via its generally vertically-extending channel from the user's shoulders down the back of the garment and into the horizontally-extending channel at the rear of the garment, at least one end of each cord being accessible to the user for pulling and securing via at least one opening in the garment; and one or more deflection surface members within the generally horizontally-extending channel at the rear of the garment configured to transition the second and third cords to a generally horizontal orientation within the generally horizontally-extending channel to minimize lateral movement of the garment about the user when the second and third cords are pulled.

2. The garment of claim 1 wherein the channels are formed by respective strips of material affixed to the interior of the garment.

3. The garment of claim 1 wherein the interiors of the generally vertically-extending channels lead into the interior of the generally horizontally-extending channel at both the front and the back of the garment.

4. The garment of claim 1 wherein the generally horizontally-extending channel is positioned on the garment to cross just below the user's breast region.

5. The garment of claim 1 wherein at least one of the generally vertically-extending channels includes a loop-shaped segment in the front of the garment formed by two generally vertically-extending arms separated by an interjacent segment lying within or formed by a section of the generally horizontally-extending channel.

6. The garment of claim 1 wherein at least one of the generally vertically-extending channels includes a loop-shaped segment in the front of the garment formed by two generally vertically-extending arms separated by an interjacent segment coupled to the generally horizontally-extending channel via adjacent channel walls that are affixed to each other or to interjacent coupling material.

7. The garment of claim 1 wherein the opening in the garment is located on the side of the garment when worn by the user.

8. The garment of claim 1 wherein the pair of generally vertically-extending channels extend over a respective shoulder of the garment-wearing user into the generally horizontally-extending channel in the rear of the garment.

9. The garment of claim 1 wherein the pair of generally vertically-extending channels extend from the front of the garment over respective shoulders of the garment-wearing user and into a common generally vertically extending channel at the rear of the garment that leads into the generally horizontally-extending channel at the rear of the garment.

10. The garment of claim 1 wherein the deflection surface members are first and second loops on the first cord through which the second and third cords respectively pass.

11. The garment of claim 1 wherein the deflection surface members are portions of the first cord's exterior surface, about which the second and third cords are looped as they extend along the generally horizontally-extending channel towards the garment opening.

12. The garment of claim 1 wherein the first cord has two end regions which are accessible to the user via said garment opening for pulling and securing.

13. The garment of claim 1 wherein the second and third cords each have two end regions, one end region being accessible to the user via said garment opening for pulling and securing, the other end region being affixed to its cord within the garment in such a way that the pulling of said one end at the garment hole permits the cord to be tensioned.

14. The garment of claim 1 wherein the at least one end of the second cord is accessible to the user for pulling and securing at the same garment opening as the at least one end of the third cord.

15. The garment of claim 1 wherein the at least one end of the second cord is accessible to the user for pulling and securing at a different garment opening as the at least one end of the third cord.

16. A garment disposed about a centerline and having a front, a back, a left side and a right side, said garment comprising:

a generally horizontally-extending channel formed in the garment to extend generally horizontally about the body of a user wearing the garment;

a pair of generally vertically-extending channels, each extending over a respective shoulder of the garment-wearing user towards or into the generally horizontally-extending channel in the front of the garment, and each being in communication with the generally horizontally-extending channel in the rear of the garment; and cords disposed in the channels in such a way that, when pulled and secured, cause the generally horizontally-extending channel to be secured about the user's body and the generally vertically-extending channels to exert a lightly sensed pressure against the user's shoulders that increases when the user slouches as a reminder to be more erect, the cords including a first cord disposed within the generally horizontally-extending channel to substantially circumscribe the user's body, second and third cords that extend through respective ones of the vertically-extending channels, passing over respective shoulders of the garment from the front of the garment, and extending down the back of the garment to a position at which they are accessible to a person wearing the garment, the second and third cords being anchored in the front of the garment by the horizontal cord in such a way that when the vertical cords are sufficiently pulled at the rear of the garment and secured in place, they lightly engage the front of the user's shoulders each time the user slouches to serve as a reminder to be more erect, said second and third cords extending from the user's shoulders down the back of the garment into the generally horizontally-extending channel at the rear of the garment, at least one end of each cord being accessible to the user for pulling and securing via at least one opening in the garment; and a pair of loops within the generally horizontally-extending channel at the rear of the garment configured to transition the second and third cords to a generally horizontal orientation within the generally horizontally-extending channel to minimize lateral movement of the garment about the user when the second and third cords are pulled.

* * * * *